US006151929A

United States Patent [19]

Mista

[11] Patent Number: 6,151,929

[45] Date of Patent: Nov. 28, 2000

[54] DEVICE FOR FASTENING ACTIVE COMPONENTS TO THE BAR OF A WRAP KNITTING MACHINE AND ACCOMPANYING TOOL FOR REMOVING AND INSTALLING THE ACTIVE COMPONENTS

[75] Inventor: Kresimir Mista, Heusenstamm., Germany

[73] Assignee: Karl Mayer Textilmachinenfabrik GmbH, Obertshausen, Germany

[21] Appl. No.: 09/451,816

[22] Filed: Nov. 30, 1999

[30] Foreign Application Priority Data

Dec. 3, 1998 [DE] Germany ..... 198 55 711

[51] Int. Cl.[7] ..... D04B 27/06

[52] U.S. Cl. ..... 66/207; 66/208; 66/203

[58] Field of Search ..... 66/203, 204, 207, 66/208, 87 R, 109, 114, 90, 206, 116

[56] References Cited

U.S. PATENT DOCUMENTS

| | | | |
|---|---|---|---|
| 2,682,163 | 6/1954 | Staff et al. | 66/208 |
| 2,687,027 | 6/1954 | Merkel | 66/206 |
| 3,952,551 | 4/1976 | Kohl | 66/206 |
| 4,643,004 | 2/1987 | Wunner | 66/208 |
| 5,966,969 | 10/1999 | Mista | 66/208 |

FOREIGN PATENT DOCUMENTS

| | | | |
|---|---|---|---|
| 2290558 | 3/1996 | United Kingdom | 66/207 |

*Primary Examiner*—Danny Worrell
*Attorney, Agent, or Firm*—Omri M. Behr, Esq.

[57] ABSTRACT

In a device for fastening active components (18) to the bar (6) of a warp knitting machine, the bar (6) has transverse channels (24) each of which is intended to receive a guide section (25) of the active component (18), and a longitudinal groove (20) for receiving holding sections (21) of the active component (18). The longitudinal groove (20) has an uncovered insertion opening area. The transverse channels (24) are arranged next to it. The holding sections (21) are wedged into the longitudinal groove (20) by means of the force of a spring (22). A tool (29) for removing and installing the active components (18) has a first driver (34) carried by an operating handle (31), which driver is fitted to a first stopper (35) on the active component (18) and contributes towards extracting the holding part (21) from the longitudinal groove (20). The result of this is a structure without play, with precise positioning and minimal weight.

26 Claims, 3 Drawing Sheets

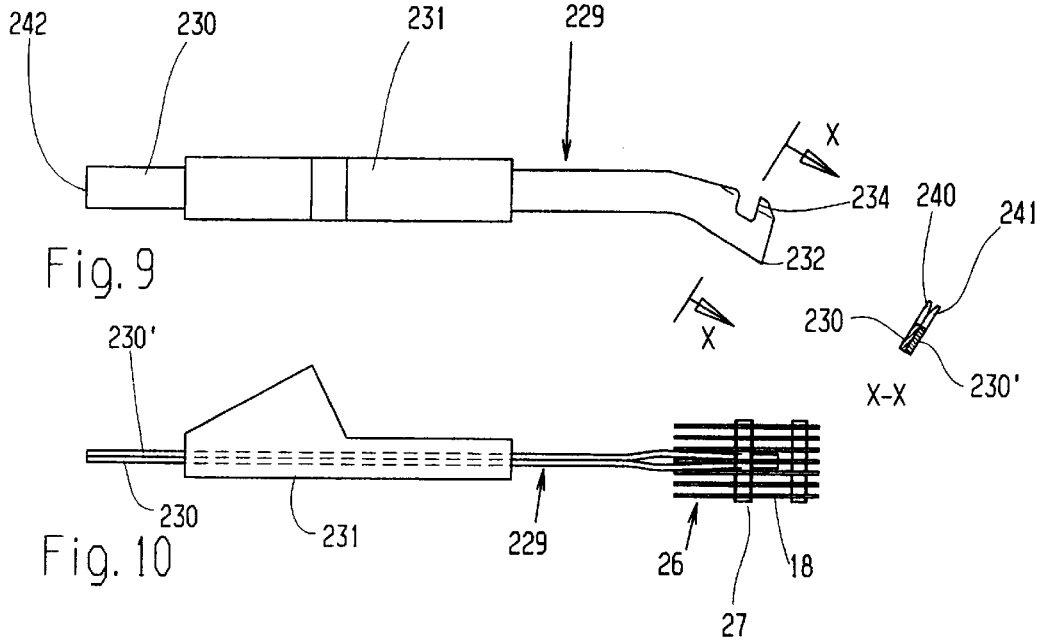
Fig. 9
Fig. 10
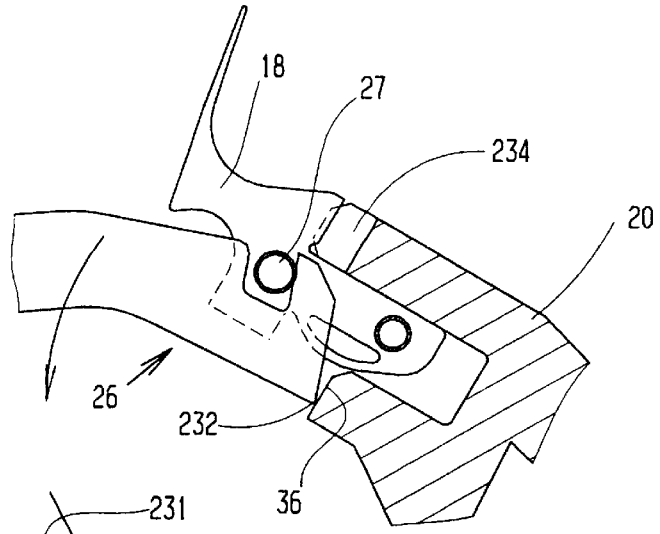
Fig. 11
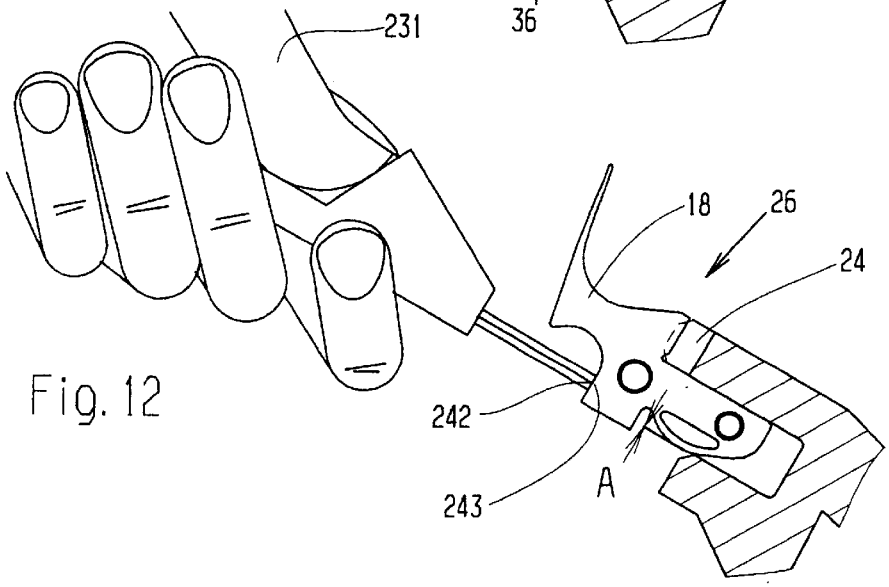
Fig. 12

DEVICE FOR FASTENING ACTIVE COMPONENTS TO THE BAR OF A WRAP KNITTING MACHINE AND ACCOMPANYING TOOL FOR REMOVING AND INSTALLING THE ACTIVE COMPONENTS

BACKGROUND OF THE INVENTION

1. Field of the Invention

The present invention relates to a device for fastening active components to the bar of a warp knitting machine, the bar having transverse channels each of which is intended to receive a guide section of the active components and a longitudinal groove for receiving holding sections of the active components, and also concerns an accompanying tool for removing and installing the active components. Such active components may be knitting needles, sliders, knocking-over sinkers, stitch comb sinkers, guide needles and many other things.

2. Description of Related Art

A fastening device according to the prior art is known from DE-PS (German patent document) 813 741. The guide sections of the active components are situated there in transverse channels, on the rear side of which passes a narrow longitudinal groove, into which short projections engage as holding parts. The active components are covered in segments by means of a pressure plate which can be fastened against the bar with a screw and wedges the active components in this way. The usually standard leads for securing the active components are omitted here. However, the pressure plates together with the screws increase the weight of the bar, thus restricting the operating speed of the warp knitting machine.

It is known from US-PS (U.S. Pat. No. ) 3,952,551 to provide a projection on a slide sinker arranged on a hooked needle, which projection rises from a longitudinal groove in which it can move freely. In this way, the position of the compound needle should adjust itself automatically into the correct position. The sides of the longitudinal groove are contoured; the contours correspond to those of the projection. In this way, the slide sinker is prevented from falling out. However, at the same time, replacing the slide sinker is rendered difficult.

The purpose of the invention is to provide a fastening device of the kind described above, in which the active components are held in the bar with minimal weight, without play and precisely in position, and, in a further embodiment, the active components can be removed and installed easily.

SUMMARY OF THE INVENTION

In accordance with the illustrative embodiments demonstrating features and advantages of the present invention, there is provided a fastening device for a warp knitting machine. The fastening device has a bar and a plurality of active components. Each of the active components has a guide section and a holding section. The bar has (a) a plurality of transverse channels, each adapted to receive the guide section of one of the active components, and (b) a longitudinal groove for receiving holding sections of the active components. The longitudinal groove having an uncovered insertion opening area next to which are arranged the transverse channels, the holding sections being wedged into the longitudinal groove by means of elastic force.

Apparatus according to the foregoing principles achieve an improved fastening device. In a preferred embodiment a longitudinal groove has an uncovered insertion opening area next to which are arranged transverse channels. Also, the holding sections are wedged into the longitudinal groove by means of elastic force. With this construction, it is possible to insert the active components easily into the longitudinal groove. They are then secured in the longitudinal groove by means of spring clamping. As insertion can only take place when the guide sections are aligned with the transverse channels, the resulting position is without play and precise. The weight is minimal, as no additional fastening means, such as pressure plates and screws, are necessary. In many cases, relatively low elastic forces are sufficient, particularly when the active component is loaded crosswise to the insertion opening area. However, even when the later load runs parallel to the insertion opening area, no or few additional measures are required in order to hold the active components securely onto the bar.

The active components are preferably designed as sinkers. The preferred structural shape, in which the active components are plate-like, is reliable and can also be used in this context.

The dimensions are preferably such that the guide section inserts into the appropriate transverse channel before the elastic force takes effect while the holding section is being pushed into the longitudinal groove. These dimensions ensure that the active component is never pushed into the longitudinal groove until the guide sections have already assumed their correct positions. In a preferred embodiment, there are means to ensure that the elastic force is produced by means of a spring bridge developed on each active component. A spring bridge of this kind can be produced very easily by means of hole cutting machines. It is particularly advisable for the longitudinal groove to have an approximately rectangular cross-section and for the spring bridge, which combines with a side panel of the longitudinal groove, to effect a slight overhang of the width of the holding section in relation to the width of the longitudinal groove in the unstressed state. A small overhang, for example of five hundredths of a millimeter, is sufficient to fasten the holding section securely in the longitudinal groove. An equally preferable alternative consists in that the elastic force is generated by means of an additionally provided spring, which is supported by the active component and also by the side of the longitudinal groove. This provides greater freedom of movement in the design. For example, it is also possible to use a spring for a plurality of active components.

A very advantageous way of achieving this structure consists in that a compound spring fits into a channel of the active component on one side and, on the other side, rests on a wedge-type surface of the side of the longitudinal groove, as well as exerting a force and a torque on the active component in such a way that the guide section is pushed against the base of the transverse channel and the holding section is pushed into a corner of the longitudinal groove.

Moreover, it is advisable for a stop spring to be arranged on the outside of the bar and that it is applied on the uncovered side of the guide section. This stop spring ensures that the active component even maintains its stable position when there are heavy loads in the insertion direction.

It is preferable for several active components to be integrated into one unit. Such units can then be assembled and removed as a unit.

It is particularly advisable here for the active components of the unit to be connected to each other by means of at least one female pin, which is parallel to the bar. The position of the individual active components is made more secure by the connecting female pins. If two or more pins are used in each unit, the result is integrated units which are exceptionally stable yet low in weight. Because of the structure of such units with connection by means of female pins, reference is made to the earlier German application 197 53 590.9 by the applicant.

A tool for removing and installing the active components is characterized according to the invention by a first driver, carried by means of an operating handle, which driver Is fitted to a primary stopper on the active component and contributes towards extracting the holding part from the longitudinal groove. The application of the first driver to the primary stopper enables the active component or the unit to be easily extracted from the longitudinal groove.

Advantageously there is, similarly, a second driver, carried by means of the operating handle, which driver is fitted to a secondary stopper on the active component and which contributes towards pushing the holding section into the longitudinal groove. The application of the second driver to the secondary stopper enables the active component and the integrated unit to be pushed into the longitudinal groove.

For the purpose of functionality, the first driver is arranged close to a tipping edge which is supported on a supporting surface adjacent to the longitudinal groove. The driver is then situated at the end of a short lever arm, while the operating handle is attached to the longer lever arm. A short movement of the operating handle is sufficient to push the active component or the unit out of the longitudinal groove.

It is also advantageous that the drivers are fitted to the female pins, which are used as stoppers. The use of the female pins as stoppers enables the even distribution of the extraction force to all active components of this unit.

Beyond this, it is advantageous that the drivers are developed on two contiguous, sheet metal strips arranged next to each other which can be pushed across a sinker of an active component with sloping surfaces (bevelled tips) provided on their uncovered end. This produces a kind of needle nose pliers which secure the active component or integrated unit which has become loosed from the longitudinal groove until the next operation takes place.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings, wherein:

FIG. 8 shows a detailed, cross-sectional, elevational view of a modified form of a slide bar with a tool for extracting and pushing in;

FIG. 9 shows a side view of an alternate tool for extracting and pushing in;

FIG. 10 shows a top plan view of the tool from FIG. 9;

FIG. 11 shows the tool from FIGS. 9 and 10 during the extraction of a unit; and FIG. 12 shows the tool from FIGS. 9 and 10 during the pushing in of a unit.

DETAILED DESCRIPTION OF THE PREFERRED EMBODIMENTS

Figure 1:
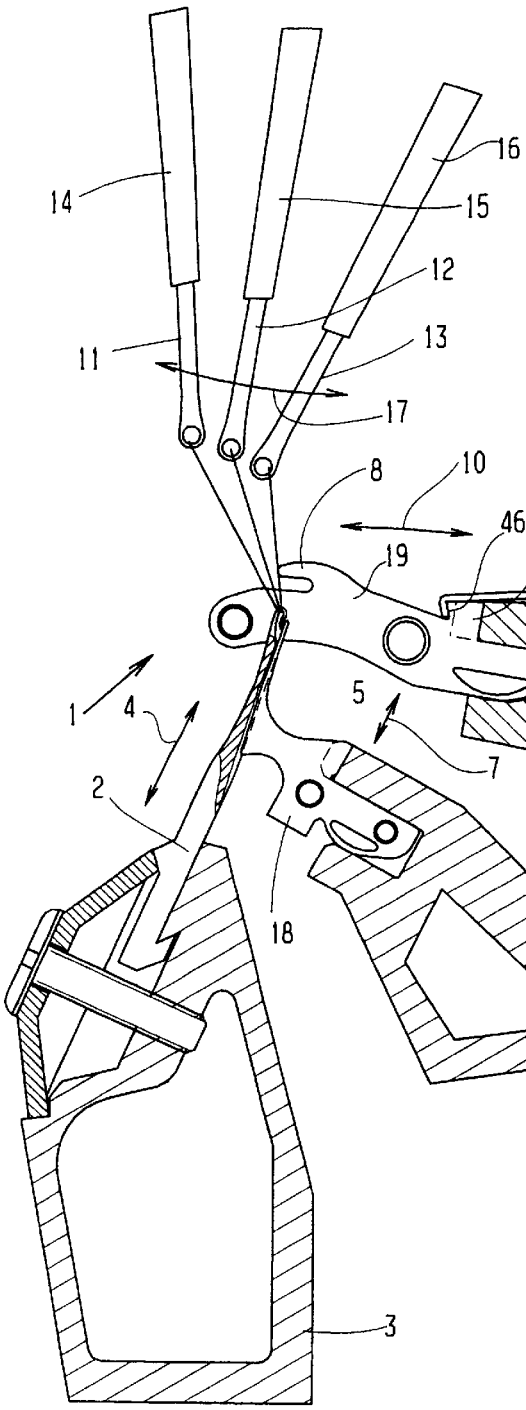
FIG. 1 is a cross-sectional, elevational view through the operative area of a warp knitting machine.

FIG. 1 shows the operative area 1 of a warp knitting machine in which several active components combine, namely hooked needles 2 on a needle bar 3 which moves up and down in the direction of the arrow 4, slider 5 on a sliding bar 6 which moves up and down in the direction of the arrow 7, holding-down and knocking-over sinkers 8 on a sinker bar 9, which moves back and forth in an approximately horizontal manner in the direction of the arrow 10, as well as guide needles 11, 12 and 13 on guide bars 14, 15 and 16 which move back and forth in the direction of the arrow 17 and are vertically offset with the plane of projection. The hooked needles 2 and the guide needles 11, 12 and 13 are fastened to their bars in a conventional manner. The active components 18, designed as sliders, and the active components 19, designed as holding-down and knocking-over sinkers, exemplify the invention.

Figure 2:
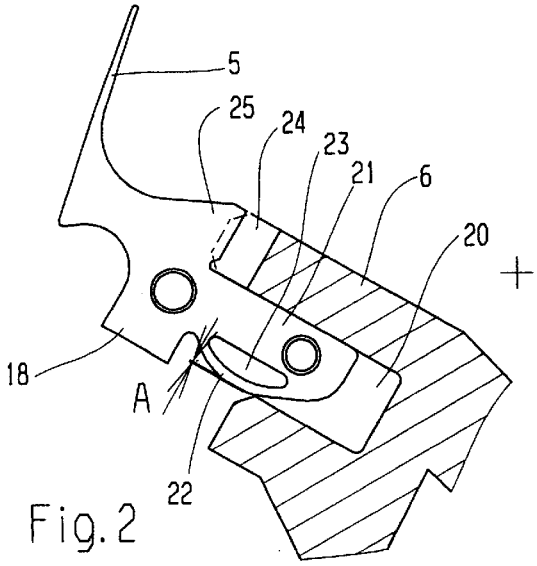
FIG. 2 shows a detailed, sectional view through a slide bar of FIG. 1.

Reference is made to FIGS. 1 through 6 in conjunction with the active components 18. The slider bar 6 has a longitudinal groove 20 with sidewalls forming an approximately rectangular cross-section, and which is open on the outside, i.e. has an uncovered insertion opening area. A holding section 21 of the active component 18 is pushed into this longitudinal groove, which holding section has, on one side, a spring bridge 22 which is formed by means of punching a hole 23. The spring bridge 22 has an overhang A in relation to the width of the longitudinal groove 20, which overhang, for example, amounts to five hundredths of a millimeter. Next to the insertion opening area are situated transverse channels 24 in which the active components 18 are held with their guide sections 25 at a precise distance. The dimensions are such that shortly before the spring bridge 22 becomes effective, the active components 18 are already situated with their guide sections 25 in the transverse channels 24. They are locked into the correct position by means of simply pushing the active components 18 into the longitudinal groove 20. FIG. 2 shows the situation shortly before pushing In to the final position, whereas the final position is illustrated in FIG. 1.

Figure 3:
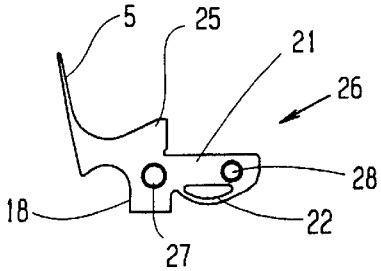
FIG. 3 shows a side elevational view of an integrated unit of the active components of FIG. 1.
Figure 4:
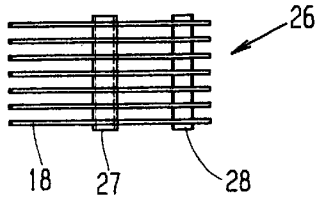
FIG. 4 shows a top plan view of the unit of FIG. 3.

As shown in FIGS. 3 and 4, several subsets of active components 18 designed as sinkers are integrated into an integrated unit in each case. This occurs with the assistance of female pins 27 and 28 which are guided through by means of holes In the active components 18 and are connected to the active components on the external circumference, e.g. by means of expansion. Such integrated units have a high level of stability, but only a low weight.

Figure 5:
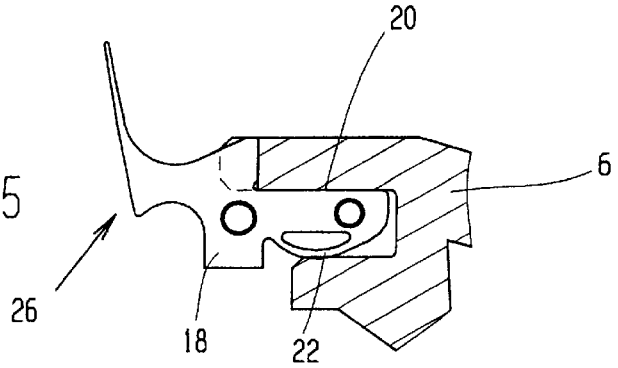
FIG. 5 shows the unit from FIG. 3 installed.
Figure 6:
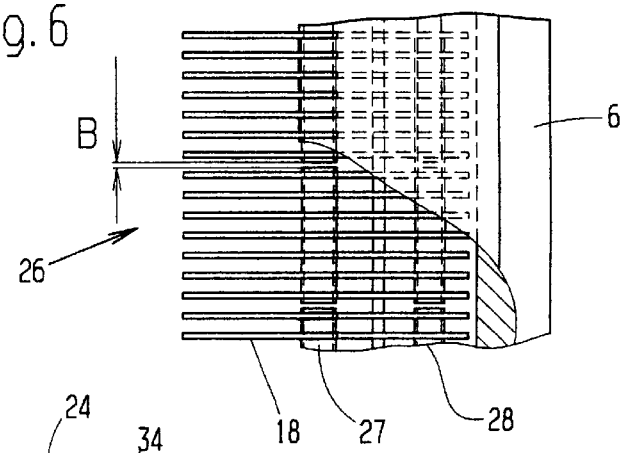
FIG. 6 shows a top plan view, with portions broken away for illustrative reason, of the unit of FIG. 5.

FIG. 5 corresponds to the fastening point according to FIG. 1 and shows, in conjunction with FIG. 6, that several integrated units 26, each adhering to a distance B between adjacent female pins 27 and 28 respectively, can be pushed into the longitudinal groove 20 of the slider bar 6.

Figure 7:
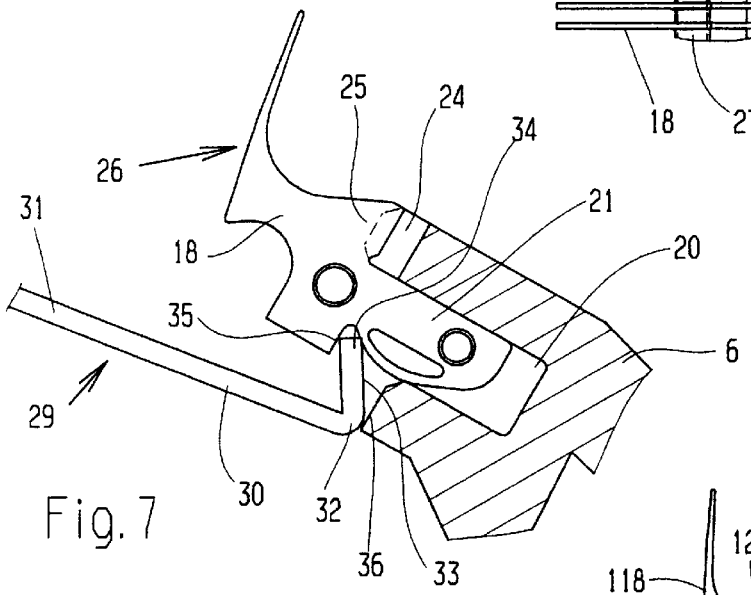
FIG. 7 shows the unit from FIG. 5 in a partially extracted state.

FIG. 7 illustrates a tool 29 in the form of a flat rolled steel strip 30 which leads from an operating handle 31 to a tipping edge 32, to which edge is connected a short lever arm 33 with a driver 34 on its uncovered end. When a levering movement is exerted on the operating handle 31, the driver 34 rests on a primary stopper 35 of the active component 18 and the tipping edge 32 rests on a supporting surface 36 of the slider bar 6. During this, the active component 18 or the unit 26 is pushed, with an extreme amount of force, out of the longitudinal groove 20 into the position illustrated in FIG. 7.

Figure 8:
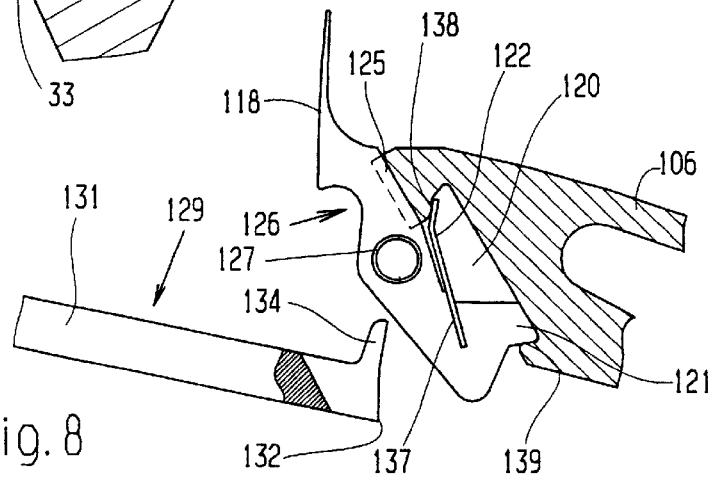

In the method of execution according to FIG. 8, the reference numerals used for corresponding parts with regard to FIGS. 1 to 7 are increased by 100. The essential difference is that the clamping force is generated by means of an additionally used compound spring 122, One end of the spring is plugged into a slot 137 of the active components 118, and it Is supported at the other end on a wedge-type surface 138 of the longitudinal groove 120. In addition, the longitudinal groove has a rounded corner 139 which forms an angle of less than 90°. The compound spring 122 generates, by virtue of the wedge-type surface 138, a force which presses the holding section 121 of the active component 118 into the corner 139, and a torque which presses the holding section 121 against the base of the longitudinal groove 120 and also presses the guide section 125 into the appropriate transverse channel.

A tool 129 has, in conjunction with an operating handle 131, a driver 134. If this driver is pushed between the female pin 127 and the compound spring 122, the integrated unit 126 can be pushed upwards to a certain extent. As a result of this, the holding section 121 is released from the corner 139 and the unit 126 can be extracted from the longitudinal groove 120. While pushing in takes place, the sequence is reversed. The driver 134 is again positioned between the female pin 127 and the compound spring 122, the unit 126 is raised and, when sufficient displacement has occurred, the unit 126 swings slightly to the right, where the holding section 121 comes back into contact with the corner 139.

FIGS. 9 and 10 show a preferred tool 229 for removing and installing the active components according to FIGS. 1 through 7. The same reference numerals are used for identical parts, and for corresponding parts, the reference numbers are increased by 200 in relation to FIGS. 1 through 7. The tool has an operating handle 231 and two contiguous, sheet metal strips 230, 230' arranged one on top of the other. These form the first driver 234 and the tipping edge 232. As the section X—X shows, the two contiguous, sheet metal strips 230 and 230' each have a sloping surface (bevelled tips) 240, 241 at their uncovered end. For this reason, it is very easy to push them in a straddling relation across an active component 18 and feed them through until they can rest on a stopper, formed by means of the female pin 27, as illustrated in FIG. 11, where the integrated unit 26 has already been extracted from the longitudinal groove 20 by quite some distance. In order to carry out the insertion, it is possible to use the back edge of the tool 229 as a driver 242, as shown in FIG. 12, where this driver combines with a secondary stopper 243 on the active component 18.

Whereas the parts described thus far have been involved with active components 18 which are loaded crosswise to the advance direction, the active component 19 illustrated in FIG. 1 concerns a sinker which moves back and forth in the insertion direction. The fastening of the active components 19 in the longitudinal groove and in the transverse channels corresponds to that of the active components 18. There is only one additional safety device by means of a supplemental spring 44 which extends along the outside of the bar 9, one end 45 of said spring inserting into a groove of the bar 9 and the other end 46 overlapping the guide section of the active component 19. This additional safety device means that even strong forces in the direction of the arrow 10 do not cause the connection to loosen.

Obviously, many modifications and variations of the present invention are possible in light of the above teachings. It is therefore to be understood that within the scope of the appended claims, the invention may be practiced otherwise than as specifically described.

What is claimed is:

1. Fastening device for a warp knitting machine, comprising:

a plurality of active components each having a guide section and a holding section; and a bar having (a) a plurality of transverse channels, each adapted to receive the guide section of one of the active components, and (b) a longitudinal groove for receiving holding sections of the active components, the longitudinal groove having an uncovered insertion opening area next to which are arranged the transverse channels, the holding sections being wedged into the longitudinal groove by means of elastic force.

2. Fastening device according to claim 1, wherein the active components are formed as sinkers.

3. Fastening device according to claim 2, wherein the active components are sized and shaped to allow the guide section to fit into an appropriate one of the transverse channel before the elastic force takes effect and while the holding section is partially inserted into the longitudinal groove.

4. Fastening device according to claim 1, wherein the active components are sized and shaped to allow the guide section to fit into an appropriate one of the transverse channel before the elastic force takes effect and while the holding section is partially inserted into the longitudinal groove.

5. Fastening device according to claim 4, wherein each active component comprises;

a spring bridge for developing the elastic force.

6. Fastening device according to claim 1, wherein each active component comprises:

a spring bridge for developing the elastic force.

7. Fastening device according to claim 6, wherein the longitudinal groove has a pair of side walls forming an approximately rectangular cross-section and wherein the spring bridge is adapted to en gage one of the side walls of the longitudinal groove, the spring bridge in the holding section having in its unstressed state a width slightly overhanging in relation to the width of the longitudinal groove.

8. Fastening device according to claim 4, wherein the longitudinal groove has a pair of side walls, said fastening device comprising:

a supplemental spring for producing the elastic force, said spring being supported by the active component and also by one of the side walls of the longitudinal groove.

9. Fastening device according to claim 8 wherein the active components each have a spring channel, and wherein the longitudinal groove has a wedge-type area to one side, and a corner opposite thereto, said fastening device comprising:

a compound spring mounted in the spring channel of the active component for resting on the wedge type area of the longitudinal groove, said compound spring being arranged to exert a force and a torque on the active component in order to push the guide section down into the transverse channel and to push the holding section into the corner of the longitudinal groove.

10. Fastening device according to claim 1, wherein the longitudinal groove has a pair of side walls, said fastening device comprising:

a supplemental spring for producing the elastic force, said spring being supported by the active component and also by one of the side walls of the longitudinal groove.

11. Fastening device according to claim 10 wherein the active components each have a spring channel, and wherein the longitudinal groove has a wedge-type area to one side, and a corner opposite thereto, said fastening device comprising:

a compound spring mounted in the spring channel of the active component for resting on the wedge-type area of the longitudinal groove, said compound spring being arranged to exert a force and a torque on the active component in order to push the guide section down into the transverse channel and to push the holding section into the corner of the longitudinal groove.

12. Fastening device according to claim 11 wherein a stop spring is mounted on the bar for engaging an exposed portion of the guide section.

13. Fastening device according to claim 4, wherein a stop spring is mounted on the bar for engaging an exposed portion of the guide section.

14. Fastening device according to claim 1, wherein a stop spring is mounted on the bar for engaging an exposed portion of the guide section.

15. Fastening device according to claim 11, wherein said plurality of active components are divided into a plurality of subsets of active components, each of the subsets of active components being integrated into an integrated unit.

16. Fastening device according to claim 4, wherein said plurality of active components are divided into a plurality of subsets of active components, each of the subsets of active components being integrated into an integrated unit.

17. Fastening device according to claim 1, wherein said plurality of active components are divided into a plurality of subsets of active components, each of the subsets of active components being integrated into an integrated unit.

18. Fastening device according to claim 17, wherein each integrated unit comprises:

at least one female pin connected to the active components of the integrated unit, said female pin being parallel to the bar.

19. Fastening device according to claim 16, wherein each integrated unit comprises:

at least one female pin connected to the active components of the integrated unit, said female pin being parallel to the bar.

20. Fastening device according to claim 4, wherein each of the active components has a primary stopper, and comprising:

a tool having a first driver with an operating handle for removing and installing the active components, the driver being adapted to engage the primary stopper on the active component and contribute towards extracting the holding section from the longitudinal groove.

21. Fastening device according to claim 1, wherein each of the active components has a primary stopper, and comprising:

a tool having a first driver with an operating handle for removing and installing the active components, the driver being adapted to engage the primary stopper on the active component and contributes towards extracting the holding section from the longitudinal groove.

22. Fastening device according to claim 21, wherein each of the active components has a secondary stopper, said tool comprising:

a second driver carried by the operating handle and adapted to engage the second stopper on the active component in order to contribute toward pushing the holding section into the longitudinal groove.

23. Fastening device according to claim 22, wherein each of the active components has a supporting surface, and wherein the tool has a tipping edge in proximity to the first driver, the tipping edge being adapted to engage the supporting surface adjacent to the longitudinal groove.

24. Fastening device according to claim 21, wherein each of the active components has a supporting surface, and wherein the tool has a tipping edge in proximity to the first driver, the tipping edge being adapted to engage the supporting surface adjacent to the longitudinal groove.

25. Fastening device according to claim 24, wherein said plurality of active components are divided into a plurality of subsets of active components, each of the subsets of active components being integrated into an integrated unit, each integrated unit having at least one female pin connected to the active components of the integrated unit, the first driver being adapted to engage the female pins.

26. Fastening device according to claim 21, wherein the active components each have a sinker, the first driver comprising:

two contiguous strips with beveled tips arranged to facilitate pushing past and straddling around a sinker of an active component.

* * * * *